US006659737B2

(12) United States Patent
Bader et al.

(10) Patent No.: US 6,659,737 B2
(45) Date of Patent: Dec. 9, 2003

(54) ELECTRONIC FLUID PUMP WITH AN ENCAPSULATED STATOR ASSEMBLY

(75) Inventors: Mark Bader, Gladstone, MI (US); Michael P. Lasecki, Gladstone, MI (US); Steven Shiverski, Perronville, MI (US); Kenneth A. DeGrave, Wilson, MI (US); Jeremy S. Carlson, Gladstone, MI (US)

(73) Assignee: Engineered Machined Products, Inc., Escanaba, MI (US)

( * ) Notice: Subject to any disclaimer, the term of this patent is extended or adjusted under 35 U.S.C. 154(b) by 0 days.

(21) Appl. No.: 09/777,391

(22) Filed: Feb. 5, 2001

(65) Prior Publication Data

US 2002/0106290 A1 Aug. 8, 2002

(51) Int. Cl.[7] ..... F04B 39/06

(52) U.S. Cl. ..... 417/366; 417/423.1; 417/423.7; 417/423.14; 415/211.2; 415/208.2; 415/226; 415/206

(58) Field of Search ..... 417/366, 423.1, 417/423.7, 423.14; 415/211.2, 208.2, 226, 206

(56) References Cited

U.S. PATENT DOCUMENTS

| | | | | |
|---|---|---|---|---|
| 3,559,539 A | * | 2/1971 | Nagy | 92/128 |
| 3,863,935 A | * | 2/1975 | Batch | 277/65 |
| 3,932,930 A | | 1/1976 | Dochterman | |
| 5,079,488 A | | 1/1992 | Harms et al. | |
| 5,096,390 A | * | 3/1992 | Sevrain et al. | 310/104 |
| 5,344,515 A | | 9/1994 | Chenock, Jr. | |
| 5,401,146 A | | 3/1995 | Moriya et al. | |
| 5,474,429 A | | 12/1995 | Heidelberg et al. | |
| 5,494,413 A | | 2/1996 | Campen et al. | |
| 5,511,942 A | * | 4/1996 | Meier | 415/211.2 |
| 5,639,227 A | * | 6/1997 | Mills | 417/423 |
| 5,810,568 A | | 9/1998 | Whitefield et al. | |
| 6,000,915 A | | 12/1999 | Hartman | |
| 6,012,909 A | | 1/2000 | Sloteman et al. | |
| 6,030,187 A | | 2/2000 | Whitefield et al. | |
| 6,056,518 A | | 5/2000 | Allen et al. | |
| 6,129,524 A | * | 10/2000 | Woollenweber et al. | 417/366 |
| 6,131,267 A | | 10/2000 | Van Den Berg | |
| 6,288,470 B1 | * | 9/2001 | Breit | 310/254 |
| 2002/0035974 A1 | | 3/2002 | Pawelick et al. | |

FOREIGN PATENT DOCUMENTS

| | | | | |
|---|---|---|---|---|
| GB | DB-2346266 A | * | 8/2000 | H02K/5/08 |

* cited by examiner

*Primary Examiner*—Charles G. Freay
*Assistant Examiner*—Emmanuel Sayoc
(74) *Attorney, Agent, or Firm*—Brooks Kushman P.C.

(57) ABSTRACT

A fluid pump includes a pump housing having a housing cavity with an inlet and an outlet. An encapsulated stator assembly is positioned within the housing cavity and at least partially defines a fluid passage from the inlet to the outlet. A polymeric capsule member encloses and seals the encapsulated stator assembly, protecting the motor from, and providing heat transfer to, the working fluid. A stator provides a magnetic field which drives a rotor assembly. The rotor assembly rotates an impeller for pumping fluid from the inlet to the outlet.

21 Claims, 9 Drawing Sheets

ELECTRONIC FLUID PUMP WITH AN ENCAPSULATED STATOR ASSEMBLY

TECHNICAL FIELD

The present invention relates to a fluid pump containing an encapsulated stator assembly that seals a pump motor and facilitates heat transfer from the motor and the electronics to the working fluid.

BACKGROUND ART

Use of fluid pumps in vehicle engine cooling systems and various industrial applications is well known. However, typical fluid pumps in both of these areas have inherent limitations.

Typically in engine cooling systems, a coolant pump has a pulley keyed to a shaft. The shaft is driven by the engine via a belt and pulley coupling, and rotates an impeller to pump the working fluid. Fluid seals sometimes fail due to the side load from the drive belt, which tends to allow fluid to leak past the seal into the bearing.

U.S. Pat. No. 6,056,518, issued on May 2, 2000 to Allen et al., describes one attempt to overcome the shortcomings of prior art vehicle coolant pumps. The '518 patent provides a fluid pump with a switched reluctance motor that is secured to a housing and rotates an impeller for pumping the fluid. This design eliminates the side load problem associated with keyed pulleys, but it is generally not intended for use where larger industrial pumps are required.

Industrial pumps are typically driven by an electric motor connected to the pump via a coupling, the alignment of which is critical. Misalignment of the coupling can result in premature pump failure, which leads to the use of expensive constant velocity couplings to overcome this problem. Moreover, industrial pumps are typically air-cooled, relying on air from the surrounding environment. The cooling air is drawn through the motor leaving airborne dust and other contaminants deposited in the motor. These deposits can contaminate the bearings, causing them to fail, or the deposits can coat the windings, shielding them from the cooling air and causing the windings to overheat and short out.

Accordingly, it is desirable to provide an improved fluid pump which overcomes the above-referenced shortcomings of prior art fluid pumps, while also providing enhanced fluid flow rate and control capability while reducing costs.

DISCLOSURE OF INVENTION

The present invention provides a fluid pump with an encapsulated stator assembly that contains a rotor cavity. A rotor assembly, driven by a stator, is positioned within this cavity and turns an impeller for pumping the working fluid. The encapsulated stator assembly prevents the working fluid from directly contacting the motor. It does, however, have an outside wall that is in contact with the working fluid, thereby facilitating heat transfer from the motor to the fluid.

More specifically, the present invention provides a fluid pump including a housing having a housing cavity therein. An encapsulated stator assembly is positioned within the housing cavity and at least partially defines a boundary for the working fluid. The encapsulated stator assembly contains a rotor cavity in which a rotor assembly is located. The magnetic field generated by a stator drives the rotor assembly, which is connected to an impeller for pumping the fluid.

In a preferred embodiment, the encapsulated stator assembly is a single unit, and is located inside a two-piece housing. A stator comprising steel laminations, windings, and motor power leads, is encapsulated in a thermally conductive, electrically insulative polymeric capsule member. The polymeric capsule member defines a rotor cavity having an opening. The rotor assembly, consists of a rotor with a rotor shaft, the rotor shaft being supported by a front bearing and a rear bearing. Also, in the preferred embodiment, the rear bearing is located within the encapsulated stator assembly, and the front bearing and a seal are positioned within a front cover that plugs the rotor cavity opening.

A diffuser is used to help direct fluid flow and thereby increase the efficiency of the pump. The diffuser comprises an inner wall, an outer wall, and a plurality of diffuser vanes. The diffuser vanes are integrally molded to the outer wall of the encapsulated stator assembly. The polymeric capsule member orients the motor power leads with substantial circumferential symmetry around the diffuser. The motor power leads then interface with a circuit board assembly near the outlet of the pump. The working fluid flows around the outside of the encapsulated stator assembly, thereby encountering the diffuser vanes and allowing heat transfer from the motor to the fluid. The working fluid then encounters the encapsulated motor power leads, thereby cooling both the motor power leads and the circuit board assembly.

In an alternative embodiment, the one piece encapsulated stator assembly is replaced with a one piece stator housing assembly. This change allows for larger motors to be utilized with the pump, and thereby increases the number of applications in which the invention may be used. The stator housing assembly includes an encapsulated stator assembly and a substantially cylindrical metal case which provides an outlet for a single bundle of motor power leads and also contains diffuser vanes that fully define the boundary of the working fluid. The encapsulated stator assembly is enclosed and sealed by a thermally conductive, electrically insulative polymeric capsule member that defines a motor cavity and provides a heat transfer path to the working fluid. As in the preferred embodiment, a rotor with a rotor shaft is located in the motor cavity and is driven by the magnetic field generated by the stator. The motor housing assembly comprises a front cover, a stator housing assembly, and a rear cover.

This alternative embodiment also has a diffuser with diffuser walls and diffuser vanes; however, there are now two sets of diffuser vanes. The front cover is configured with a first set of diffuser vanes and the stator housing assembly is configured with a second set of diffuser vanes. The two covers and the stator housing assembly are joined together and sealed in a manner to prevent the working fluid from entering the motor cavity.

Accordingly, an object of the present invention is to provide a fluid pump with an encapsulated stator assembly, the encapsulated stator assembly orienting the motor components and providing heat transfer between the motor and the working fluid.

Another object of the invention is to provide a fluid pump with an encapsulated stator assembly, the encapsulated stator assembly forming a diffuser, including a plurality of diffuser vanes. The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT

Figure 1:
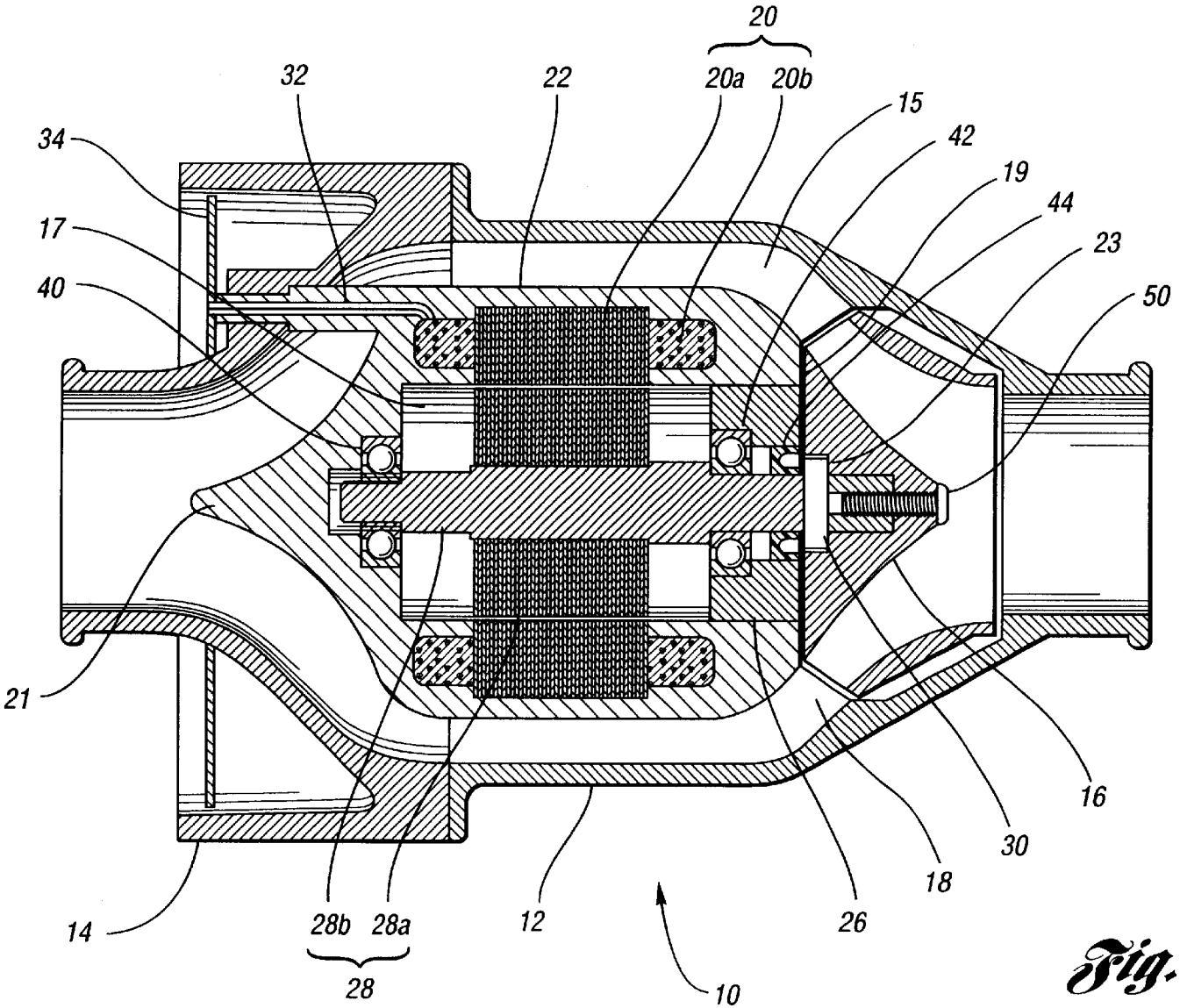
FIG. 1 shows a longitudinal cross-sectional view of a fluid pump in accordance with the present invention.

FIG. 1 shows a longitudinal cross-sectional view of a fluid pump 10 in accordance with the present invention. A two-piece pump housing comprises an inlet pump housing 12 and an outlet pump housing 14. The pump housing has a housing cavity 15 therein which contains an encapsulated stator assembly 22.

Figure 2:
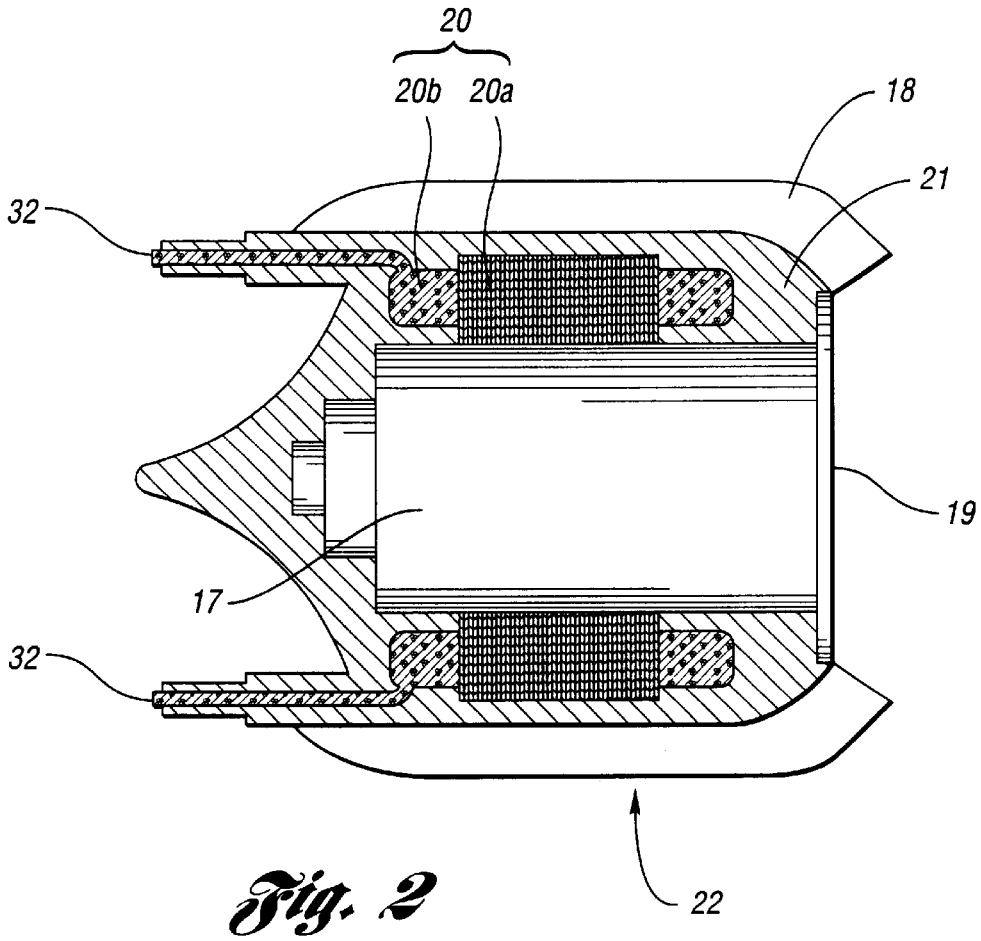
FIG. 2 shows a longitudinal cross-sectional view of an encapsulated stator assembly for use with the pump shown in FIG. 1.

Referring to FIG. 2, the encapsulated stator assembly 22 defines a rotor cavity 17 with an opening 19. The encapsulated stator assembly 22 comprises a polymeric capsule member 21, that has a plurality of diffuser vanes 18 molded integrally thereon. Polymeric capsule member 21 encloses and seals a motor stator 20 and motor power leads 32. Thus, when the fluid pump 10 is used in an engine cooling system, the motor stator 20 and motor power leads 32 are protected from the liquid engine coolant. Motor stator 20 comprises a plurality of steel laminations 20*a* and a plurality of copper windings 20*b*.

Returning to FIG. 1, located within rotor cavity 17 is a rotor assembly 28, consisting of a rotor 28*a* and a rotor shaft 28*b*. The rotor shaft 28*b* is supported by a front bearing 42 and a rear bearing 40. Rear bearing 40 is located within the encapsulated stator assembly 22. Front bearing 42 and seal 44 are located within the front cover 26 that plugs the rotor cavity opening 19.

Figure 3:
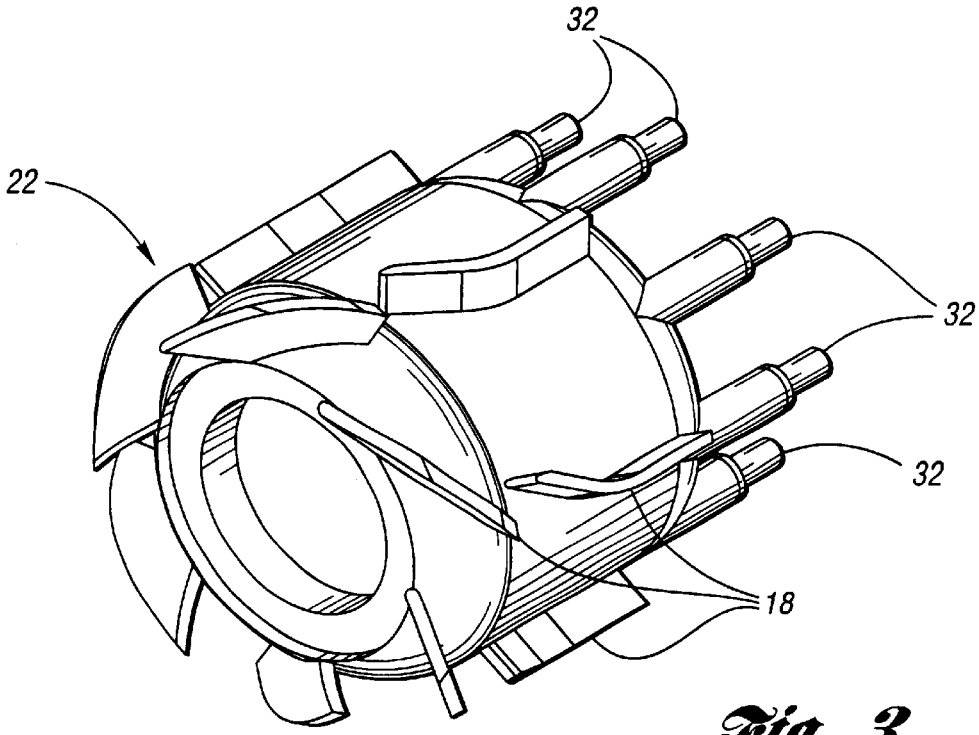
FIG. 3 shows a perspective view of the encapsulated stator assembly, with the motor cavity opening toward the front and the motor power leads toward the back.

FIG. 3 shows a front perspective view of encapsulated motor assembly 22. In particular, it shows diffuser vanes 18 which are of split construction (but need not be of split construction for this invention), and the motor power leads 32 which are oriented with substantial circumferential symmetry around the longitudinal axis of the encapsulated stator assembly 22. As seen in FIG. 1, motor power leads 32 interface with a circuit board assembly 34.

Returning to FIG. 1 impeller 16 is slip fit onto the rotor shaft 28*b* and secured with a buttonhead capscrew 50. A drive pin 30 transversely located through rotor shaft 28*b* drives impeller 16 via slot 23.

Figure 4:
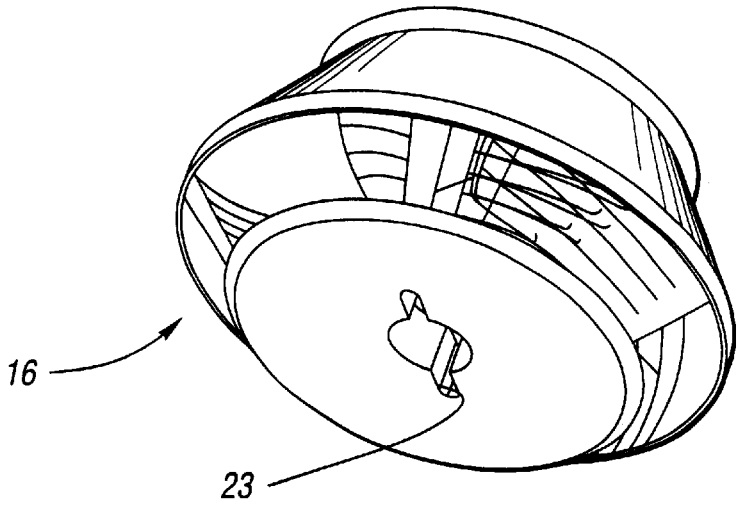
FIG. 4 shows a rear perspective view of an impeller for use with the pump shown in FIG. 1.
Figure 5:
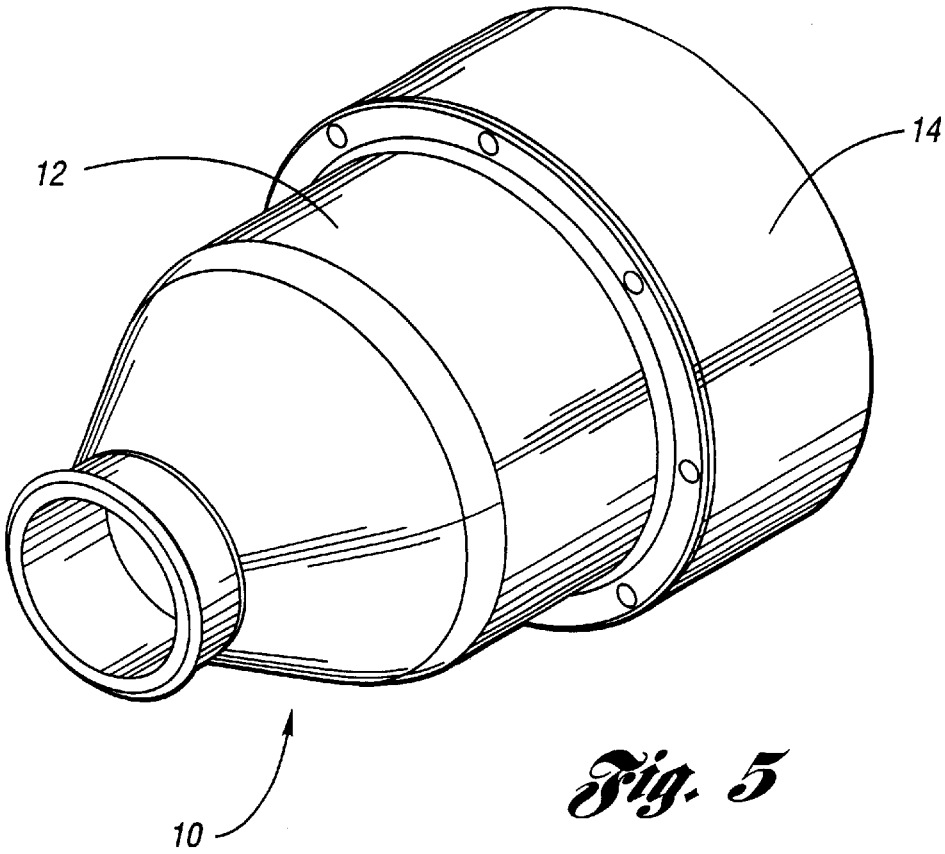
FIG. 5 shows a perspective view of a two piece pump housing with an inlet housing toward the front and an outlet housing toward the rear for use with the pump shown in FIG. 1.
Figure 6:
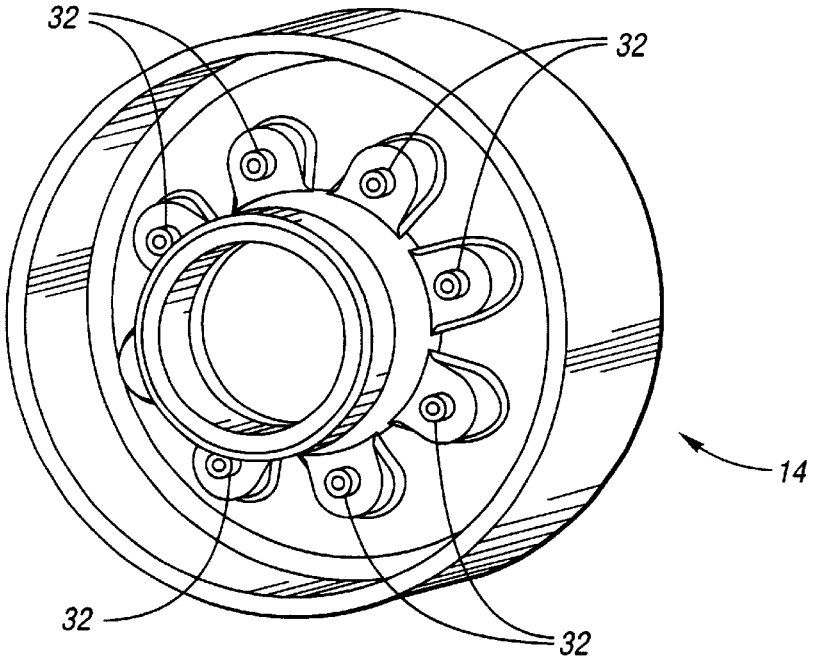
FIG. 6 shows a perspective view of the outlet housing corresponding with the embodiment of FIG. 1.
Figure 7:
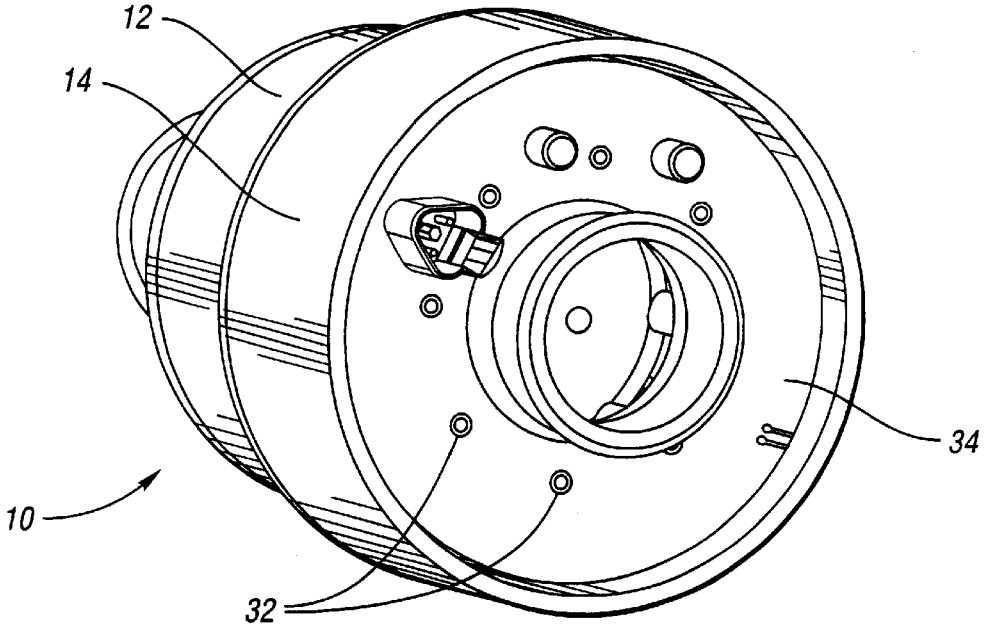
FIG. 7 shows a perspective view of the outlet housing of FIG. 6, with a circuit board assembly attached.

FIG. 4 shows impeller 16 with slot 23 configured to receive drive pin 30. FIG. 5 shows the inlet pump housing 12 attached to the outlet pump housing 14. Outlet pump housing 14 is again shown in FIG. 6, this time with motor power leads 32. FIG. 7 shows the outside of pump 10 including the inlet pump housing 12, the outlet pump housing 14, the circuit board assembly 34, and the connection points between circuit board assembly 34 and the motor power leads 32.

Figure 8:
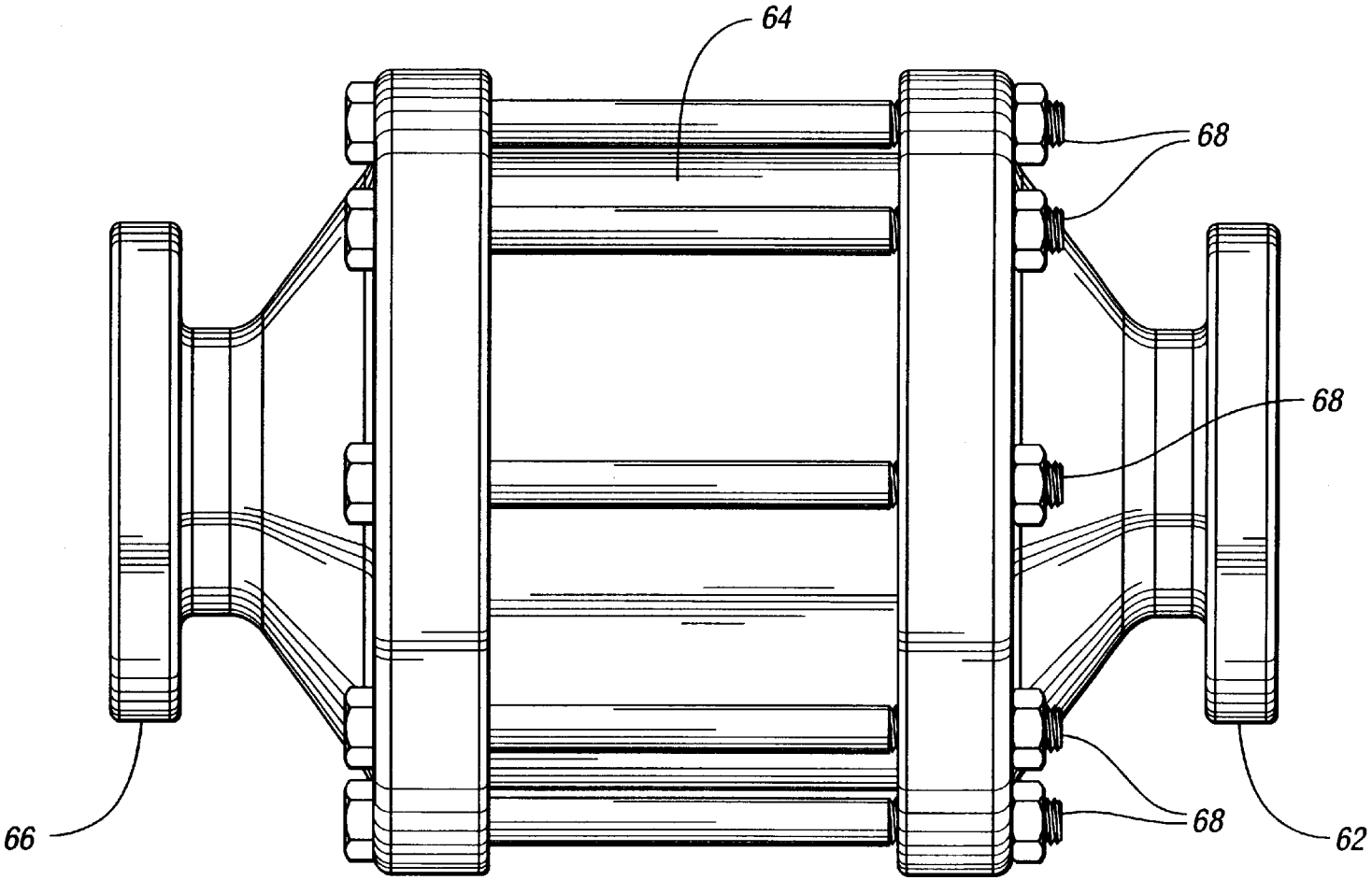
FIG. 8 shows a side view of a fluid pump in accordance with an alternative embodiment of the invention.

Referring to FIG. 8, a fluid pump 60 is shown in accordance with one alternative embodiment of the invention. Although similar in function to the preferred embodiment, there are a number of notable differences with regard to form. Rather than a two-piece housing, this embodiment employs a three-piece housing comprising an inlet housing 62, a stator housing assembly 64, and an outlet housing 66, assembled with bolts 68.

Figure 10:
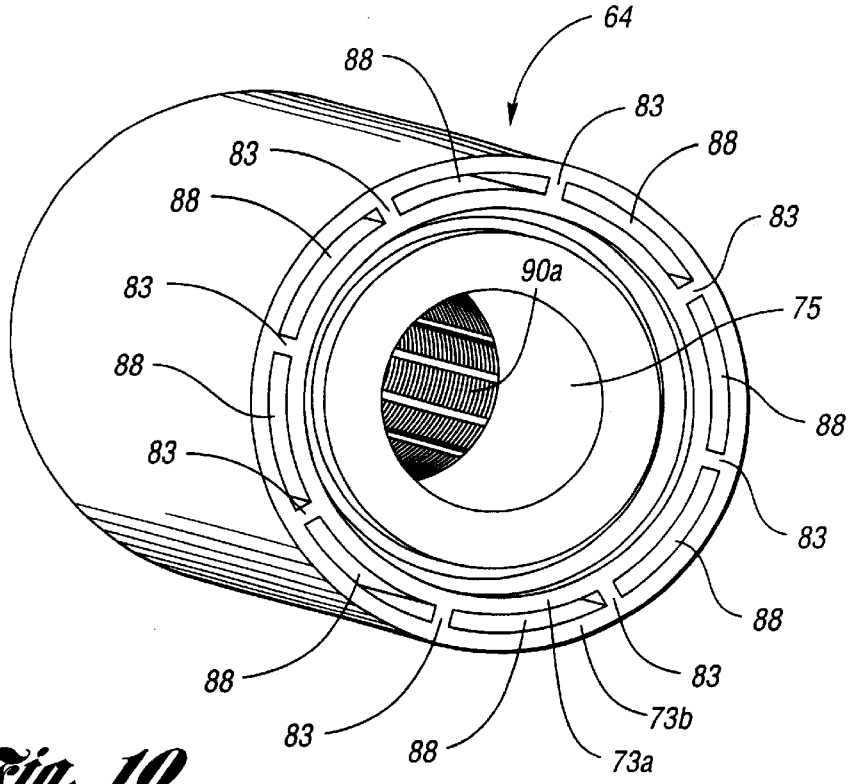
FIG. 10 shows a perspective view of the stator housing assembly of the fluid pump of FIG. 8.
Figure 11:
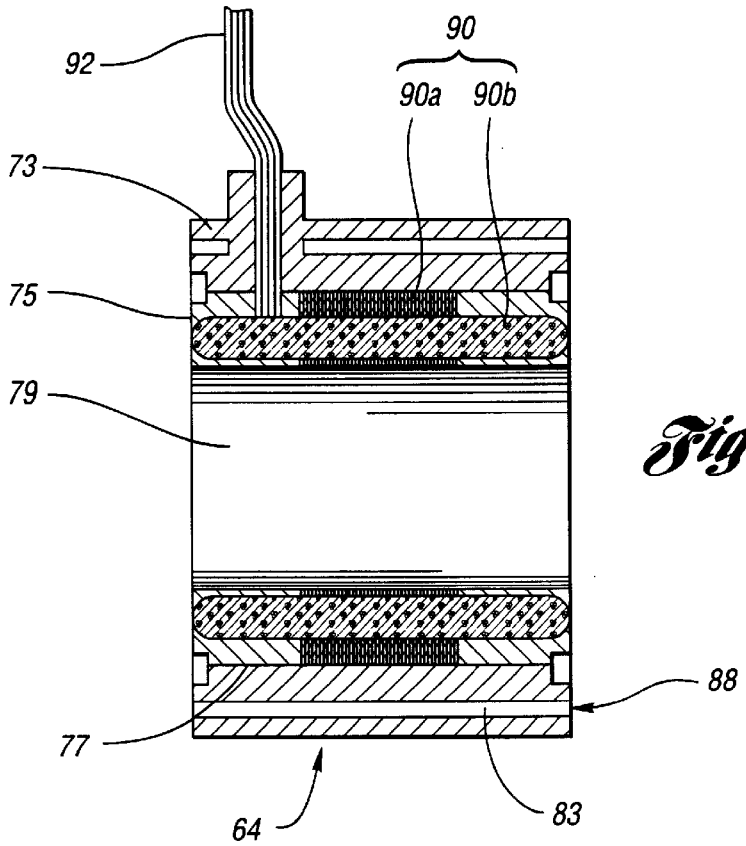
FIG. 11 shows a longitudinal cross-sectional view of the stator housing assembly of FIG. 10.

The stator housing assembly 64, shown in FIG. 10 and sectioned in FIG. 11, includes an encapsulated stator assembly 75 and a substantially cylindrical metal case 73 which provides an outlet for a single bundle of motor power leads 92 and diffuser vanes 83 that fully define the boundary of the working fluid. The encapsulated stator assembly 75 includes a plurality of steel laminations 90*a*, a plurality of windings 90*b*, and a plurality of motor power leads 92. A polymeric capsule member 77 encloses and seals the stator assembly 90, and also defines a rotor cavity 79.

Figure 9:
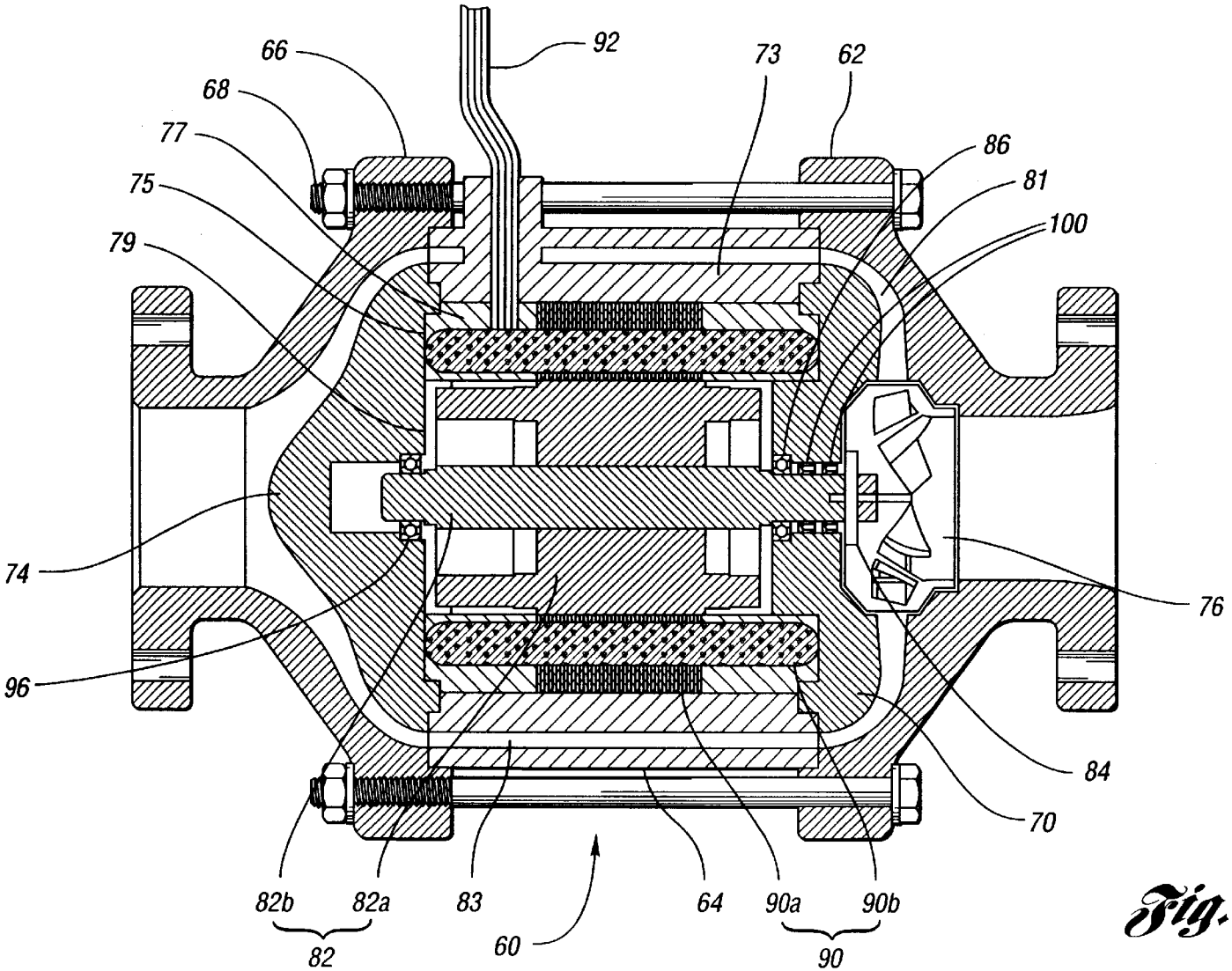
FIG. 9 shows a longitudinal cross-sectional view of the fluid pump shown in FIG. 8.

As shown in FIG. 9, a rotor assembly 82, consisting of a rotor 82*a* and a rotor shaft 82*b*, mislocated within rotor cavity 79. Rotor shaft 82*b* is supported by a rear bearing 96 positioned within the rear cover 74 which plugs the rear opening of the rotor cavity 79, and a front bearing 86 and seals 100 positioned within a front cover 70 which plugs the forward opening of the rotor cavity 79. Drive pin 84 is positioned transversely through rotor shaft 82*b* and drives impeller 76.

Referring to FIG. 9, unlike the preferred embodiment, this alternative embodiment has two separate sets of diffuser vanes, the first set 81 being configured on the front cover 70 and the second set 83 being configured on the stator housing assembly 64.

FIGS. 10 and 11 clearly show the resultant fluid passage 88 formed between the vanes 83 and the inner and outer walls 73*a*, 73*b* of the metal case 73.

The encapsulated stator assembly 75 may be manufactured by locating the stator assembly 90 within the substantially cylindrical metal case 73 and temporarily capping the two open ends of the metal case. The stator assembly 90 would then be encapsulated in a polymeric thermally conductive, electrically insulative material 77. The opposing ends of the metal case would be uncapped, and the front and rear covers 70, 74 would be attached to the metal case to complete the encapsulated stator assembly 75.

Figure 12:
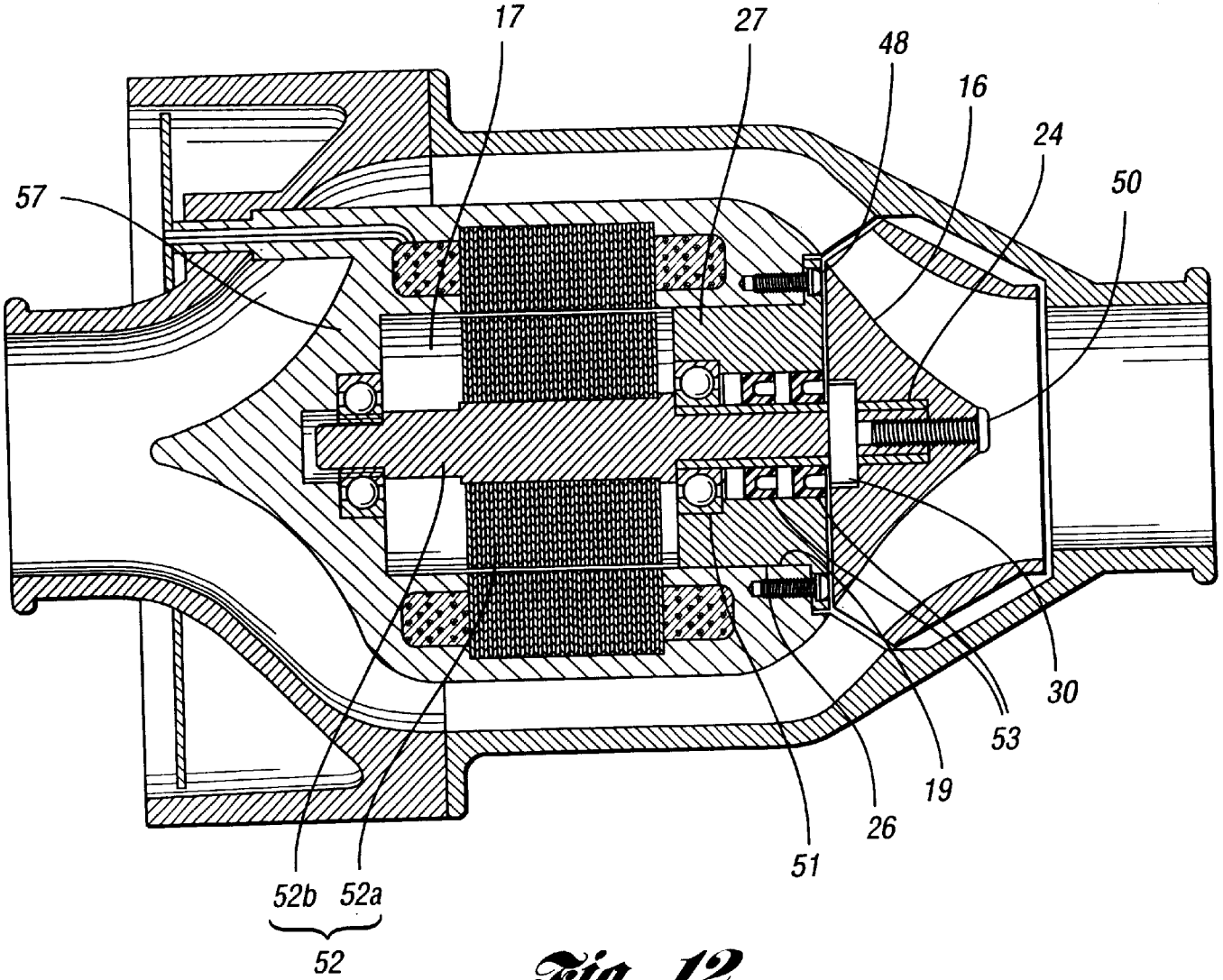
FIG. 12 shows a longitudinal cross-sectional view of a second alternative embodiment of the fluid pump of FIG. 1.

FIG. 12 shows a second alternative embodiment of the fluid pump of FIG. 1. Seal cartridge assembly 26 plugs opening 19 in rotor cavity 17. Wear sleeve 24 is slip fit over the end of rotor shaft 52*b*. An impeller 16 is slip fit onto wear sleeve 24 and is secured to rotor shaft 52*b* with a buttonhead capscrew 50. A drive pin 30 transversely located through rotor shaft 52*b* and wear sleeve 24 serves multiple functions. The drive pin 30 drives impeller 16 via slot 23 (similarly as shown in FIG. 4); it prevents wear sleeve 24 from rotating relative to rotor shaft 52*b;* it captures axial loads from rotor assembly 52.

Figure 13:
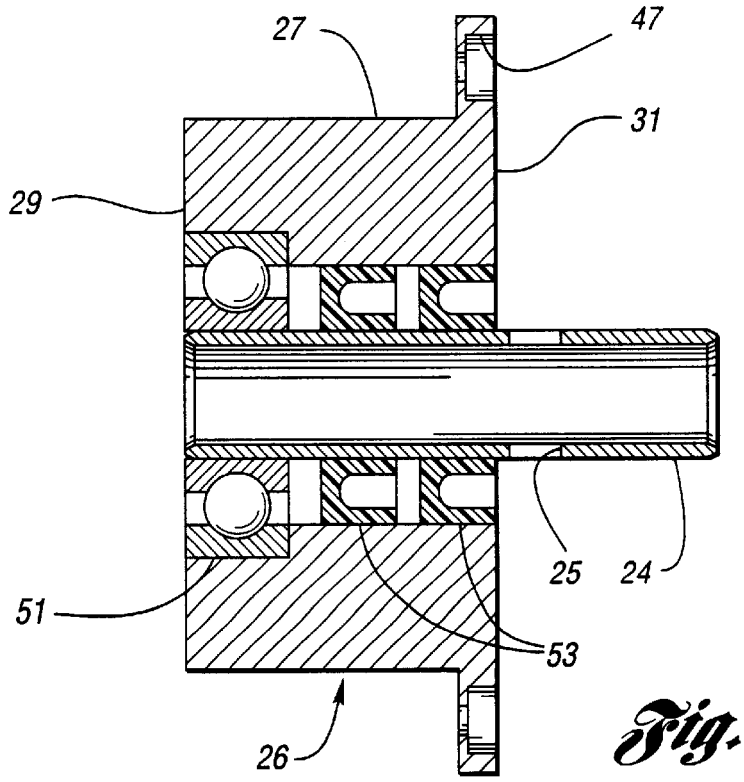
FIG. 13 shows a longitudinal cross-sectional view of a seal cartridge assembly for use with the pump shown in FIG. 12.

Some of the features and components of the seal cartridge assembly 26 are shown in FIGS. 12 and 13. Body 27 has a wet side 31 in contact with the working fluid, such as a liquid engine coolant, and a dry side 29. The body 27 also contains a plurality of holes 47 for attaching the seal cartridge assembly 26 to the encapsulated stator assembly 57, using bolts 48. A seal 53 is press fit into the body 27 and plugs an opening on the wet side 31.

Figure 14:
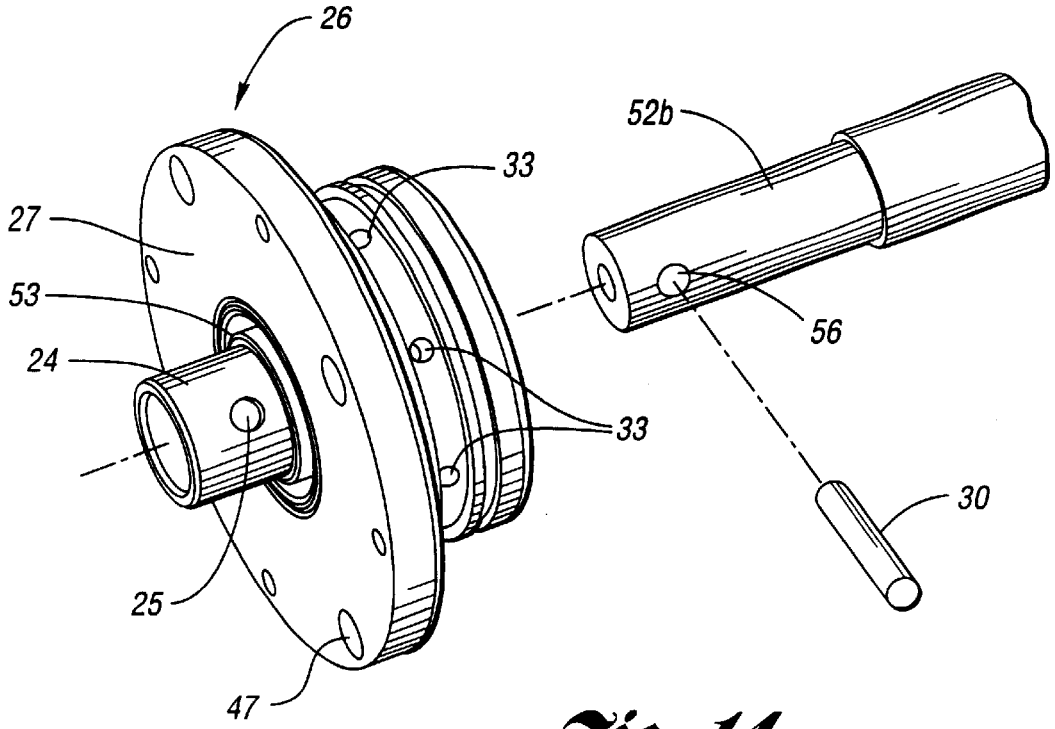
FIG. 14 shows a perspective view of the seal cartridge assembly and one end of the rotor shaft with a drive pin for use with the pump shown in FIG. 12.

Referring to FIG. 14, the wear sleeve 24 is machined to form an inner diameter and has an axis coaxial to an axis of the body 27. A hole 25 is machined transverse to the wear sleeve axis and is configured to receive drive pin 30. The rotor shaft 52*b* has a transverse hole 56 that also receives drive pin 30.

Returning to FIG. 13, the front bearing 51, being press fit onto the substantially cylindrical wear sleeve 24, plugs an opening on the dry side 29. The bearing 51 and wear sleeve 24 are press-fit into the cartridge body, and the wear sleeve 24 is slip fit over the shaft 52*b*. The seal cartridge assembly 26 also contains leak detection ports 33, shown in FIG. 14, for visual or electronic indication of seal 53 failure.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A fluid pump, comprising:

a housing having a housing cavity therein with an inlet and an outlet;

an impeller rotatably positioned at the inlet and having an impeller axis;

an encapsulated stator assembly enclosed and sealed by a polymeric capsule member, the polymeric capsule member defining a rotor cavity having an opening, and orienting motor power leads with substantial circumferential symmetry around the impeller axis, the encapsulated stator assembly including a plurality of steel laminations, a plurality of copper windings, and a plurality of motor power leads;

a rotor assembly rotatably located inside the rotor cavity and connected to the impeller for rotating the impeller for pumping fluid through the passage from the inlet to the outlet; and a seal cartridge assembly positioned within the opening for sealing the rotor assembly within the rotor cavity.

2. The fluid pump of claim 1, wherein the polymeric capsule member comprises a thermally conductive, electrically insulative material.

3. The fluid pump of claim 1, further comprising a circuit board assembly located near the outlet and interfacing with the motor power leads.

4. The fluid pump of claim 1, further comprising a diffuser, wherein the diffuser comprises an inner wall formed by an outer wall of the encapsulated stator assembly, an outer wall formed by an inner wall of the housing, and a plurality of diffuser vanes.

5. The fluid pump of claim 4, wherein the outer wall of the encapsulated stator assembly is configured with the diffuser vanes.

6. The fluid pump of claim 1, wherein the rotor assembly consists of a rotor with a rotor shaft.

7. The fluid pump of claim 6, wherein the rotor shaft is supported by a front bearing and a rear bearing.

8. A fluid pump, comprising:

a housing having a housing cavity therein with an inlet and an outlet;

an encapsulated stator assembly enclosed and sealed by a polymeric capsule member, the polymeric capsule member being separate from the housing and enclosing the stator assembly in such a way as to provide substantial contact with outer peripheral surfaces of the stator assembly, thereby minimizing voids therebetween and facilitating conductive heat transfer between the stator assembly and the capsule member, wherein the polymeric capsule member defines a rotor cavity having an opening; and wherein an outer wall of the polymeric capsule member has a plurality of diffuser vanes molded integrally thereon, the diffuser vanes being separate from the housing.

9. The fluid pump of claim 8, wherein the polymeric capsule member comprises a thermally conductive, electrically insulative material.

10. The fluid pump of claim 8, wherein the encapsulated stator assembly comprises a plurality of steel laminations, a plurality of copper windings, and a plurality of motor power leads.

11. The fluid pump of claim 10, wherein the polymeric capsule member orients the motor power leads with substantial circumferential symmetry around the impeller axis.

12. The fluid pump of claim 10, further comprising a circuit board assembly located near the outlet and interfacing with the motor power leads.

13. A fluid pump, comprising:

a housing having a housing cavity therein with an inlet and an outlet;

an encapsulated stator assembly enclosed and sealed by a polymeric capsule member;

wherein the encapsulated stator assembly contains a plurality of motor power leads encased in the polymeric capsule member, and having exposed ends, the motor power leads being at least partially within the fluid flow path; and a circuit board assembly positioned near the outlet and interfacing with the ends of the motor power leads.

14. The fluid pump of claim 13, wherein the polymeric capsule member comprises a thermally conductive, electrically insulative material.

15. The fluid pump of claim 13, wherein the polymeric capsule member orients the motor power leads with substantial circumferential symmetry around the impeller axis.

16. The fluid pump of claim 13, further comprising a diffuser, wherein the diffuser comprises an inner wall formed by the outer wall of the encapsulated stator assembly, an outer wall formed by the inner wall of the housing, and a plurality of diffuser vanes.

17. The fluid pump of claim 16, wherein the outer wall of the encapsulated stator assembly is configured with the diffuser vanes.

18. A fluid pump, comprising:

a housing having a housing cavity therein with an inlet and an outlet;

an impeller rotatably positioned at the inlet and having an impeller axis;

an encapsulated stator assembly enclosed and sealed by a polymeric capsule member, the polymeric capsule member defining a rotor cavity having an opening, and orienting motor power leads with substantial circumferential symmetry around the impeller axis, the encapsulated stator assembly including a plurality of steel laminations, a plurality of copper windings, and a plurality of motor power leads; and wherein the polymeric capsule member comprises a thermally conductive, electrically insulative material.

19. The fluid pump of claim 18, further comprising a circuit board assembly located near the outlet and interfacing with the motor power leads.

20. The fluid pump of claim 18, further comprising a diffuser, wherein the diffuser comprises an inner wall formed by an outer wall of the encapsulated stator assembly, an outer wall formed by an inner wall of the housing, and a plurality of diffuser vanes.

21. The fluid pump in claim 20, wherein the outer wall of the encapsulated stator assembly is configured with the diffuser vanes.

* * * * *